US007766069B2

(12) United States Patent
Ni et al.

(10) Patent No.: US 7,766,069 B2
(45) Date of Patent: Aug. 3, 2010

(54) OVERHEAD GARAGE DOOR WITH SEAM CONCEALER

(75) Inventors: Xiao-Ming Ni, Zhejiang (CN); Jennifer Armstrong Maher, Chevy Chase, MD (US)

(73) Assignee: FrenchPorte IP, L.L.C., Rockville, MD (US)

( * ) Notice: Subject to any disclaimer, the term of this patent is extended or adjusted under 35 U.S.C. 154(b) by 278 days.

(21) Appl. No.: 11/328,454

(22) Filed: Jan. 10, 2006

(65) Prior Publication Data

US 2006/0185801 A1 Aug. 24, 2006

Related U.S. Application Data

(63) Continuation-in-part of application No. 11/229,713, filed on Sep. 20, 2005, now abandoned, which is a continuation of application No. 10/098,384, filed on Mar. 18, 2002, now Pat. No. 6,948,547.

(51) Int. Cl.
*E06B 3/48* (2006.01)

(52) U.S. Cl. ..... 160/229.1; 160/201; 160/40

(58) Field of Classification Search ..... 160/229.1, 160/201, 236, 235, 40; 49/383, 496.1, 483.1; 16/355; 292/DIG. 36
See application file for complete search history.

(56) References Cited

U.S. PATENT DOCUMENTS

| | | | |
|---|---|---|---|
| 1,784,292 | A | 12/1930 | Johnson |
| 1,881,778 | A | 10/1932 | Madsen |
| 1,922,370 | A | 8/1933 | Johnson et al. |
| 1,989,658 | A | 1/1935 | McCloud |
| 2,017,012 | A | 10/1935 | Morgan |
| 2,023,691 | A | 12/1935 | McCloud |
| 2,093,020 | A | 9/1937 | Norberg |
| 2,242,499 | A | 5/1941 | Ainsworth |
| 2,759,227 | A | 8/1956 | Reid et al. |
| 2,861,836 | A | 11/1958 | Goeggel |
| 2,951,533 | A | 9/1960 | Lucas et al. |
| 3,003,200 | A | 10/1961 | Hansen |
| 3,078,917 | A | 2/1963 | Recchione |
| 3,118,189 | A | 1/1964 | Dugger |

(Continued)

FOREIGN PATENT DOCUMENTS

| | | |
|---|---|---|
| DE | 10310628 A1 | 10/2004 |

(Continued)

OTHER PUBLICATIONS

International Search Report dated Nov. 21, 2007.

*Primary Examiner*—Blair M. Johnson
(74) *Attorney, Agent, or Firm*—Banner & Witcoff, Ltd.

(57) ABSTRACT

An overhead garage door having a concealing apparatus between adjoining horizontal sections of the door is provided. The garage door may include horizontal sections and the door may be formed from a plurality of these sections, arranged in a stack, and pivotally connected to adjacent sections. The concealing apparatus, such as meeting rails, may be attached to adjacent horizontal sections to mask the appearance of a seam created as adjacent sections are joined. The meeting rails may also aid in sealing the door to form a weather-tight seal and keep wind, moisture and debris out of the garage. The concealing apparatus may also be an overlapping plate with an attachment region and an overhanging region.

24 Claims, 18 Drawing Sheets

U.S. PATENT DOCUMENTS

| | | | | |
|---|---|---|---|---|
| 3,135,544 | A | | 6/1964 | Mickey et al. |
| 3,217,784 | A | | 11/1965 | Wolf et al. |
| 3,221,465 | A | * | 12/1965 | McKee ..... 52/656.4 |
| 3,683,652 | A | * | 8/1972 | Halopoff et al. ..... 70/467 |
| 3,922,816 | A | | 12/1975 | Hormann |
| D245,263 | S | | 8/1977 | Andresen |
| D245,264 | S | | 8/1977 | Andresen |
| D245,265 | S | | 8/1977 | Andresen |
| 4,060,437 | A | | 11/1977 | Strout |
| 4,312,328 | A | | 1/1982 | Leyman, III |
| 4,339,487 | A | | 7/1982 | Mullet |
| D273,230 | S | | 3/1984 | Martinez et al. |
| D283,923 | S | | 5/1986 | Henry et al. |
| D300,466 | S | | 3/1989 | Widner |
| 4,854,365 | A | | 8/1989 | Juneau |
| 5,016,700 | A | | 5/1991 | Wegner et al. |
| 5,060,711 | A | | 10/1991 | Fimbell |
| 5,123,211 | A | | 6/1992 | Schlicht et al. |
| D330,089 | S | | 10/1992 | Bonger |
| 5,163,493 | A | | 11/1992 | Kraeutler |
| 5,168,915 | A | | 12/1992 | LaFleur |
| 5,341,597 | A | | 8/1994 | Stoltenberg |
| 5,373,663 | A | | 12/1994 | Turini |
| 5,577,541 | A | | 11/1996 | McKeon |
| D378,421 | S | | 3/1997 | Forsland |
| D378,853 | S | | 4/1997 | Forsland |
| 5,626,176 | A | | 5/1997 | Lewis, Jr. et al. |
| D380,053 | S | | 6/1997 | Forsland |
| D382,065 | S | | 8/1997 | Forsland |
| D382,066 | S | | 8/1997 | Forsland |
| D382,067 | S | | 8/1997 | Forsland |
| D383,551 | S | | 9/1997 | Forsland |
| D389,921 | S | | 1/1998 | Lee |
| D397,447 | S | | 8/1998 | Forsland |
| 5,848,630 | A | | 12/1998 | Munzo |
| 5,852,903 | A | | 12/1998 | Astrizky |
| 6,079,168 | A | | 6/2000 | Shaver |
| 6,227,278 | B1 | | 5/2001 | Forsland |
| 6,314,689 | B1 | | 11/2001 | Hughes |
| D452,979 | S | | 1/2002 | Maher |
| 6,446,695 | B1 | | 9/2002 | Forsland |
| 2003/0005636 | A1 | | 1/2003 | Forsland |
| 2003/0221803 | A1 | | 12/2003 | Forsland |

FOREIGN PATENT DOCUMENTS

| | | | |
|---|---|---|---|
| WO | 9841723 | | 9/1998 |
| WO | 2004029395 | A2 | 4/2004 |

* cited by examiner

OVERHEAD GARAGE DOOR WITH SEAM CONCEALER

CROSS REFERENCE TO RELATED APPLICATIONS

This application is a continuation-in-part of U.S. patent application Ser. No. 11/229,713 filed Sep. 20, 2005, which is a continuation of U.S. Pat. No. 6,948,547, filed Mar. 18, 2002 and entitled "Overhead Garage Door With Decorative Facade Elements." The contents of these applications are expressly incorporated herein by reference.

TECHNICAL FIELD

This invention relates generally to a sectional door having a seam concealing apparatus. More particularly, the present invention relates to a sectional door seam concealing apparatus that conceals seam lines between hingedly-connected sections of a sectional door, such as an overhead garage door, and to an overhead garage door having the same.

BACKGROUND

Garage doors are generally known in the art as structures that form a movable barrier in an entryway to a garage or other type of building. Conventional overhead garage doors are formed from a vertical stack of horizontally folding sections interconnected by hinges and supported by a guide track.

Visible seams are created in these conventional doors where the horizontal panels of the door meet when in the closed, vertical position. These seams detract from the aesthetics of the door and may allow moisture, wind and debris to penetrate through the garage door. Repeated use of the door over extended periods may cause these seams to widen further, allowing more moisture, wind and debris into the garage, reducing the insulation capabilities of the door and further detracting from the aesthetics of the door.

SUMMARY

Aspects of the present invention provide a sectional door having concealed seam lines between hingedly-connected sections of the door when in a closed position. In addition, aspects of the present invention provide good sealing capabilities at the seams of such a door in a closed position to prevent moisture, wind and debris from penetrating through the door. Further aspects provide an overhead garage door formed of hingedly-connected sections that interconnect while in the closed position to provide a robust, rigid door.

In one embodiment, a sectional door includes a set of meeting rails installed on adjacent, hingedly-connected sections of the door. The meeting rails may be asymmetrical and may be joined by a surface mounted hinge. The meeting rails mask the seam created where the adjacent sections meet when in a closed position. In addition, the meeting rails can provide improved sealing and insulation for the door by providing a barrier against moisture, wind and debris.

The meeting rails could be connected to their respective sections via thru bolts. In one embodiment, an upper meeting rail is connected to a bottom edge of a horizontal section while a lower meeting rail is connected to the opposite top edge of the section. When the sections are arranged in a closed position, such as in a vertical stack, opposing meeting rails join and mask the seam created between the adjacent sections.

According to further aspects of the invention, the meeting rails of the garage door can include overhanging lips that can aid in aligning the meeting rails upon installation. In addition, the lips can aid in securing the upper and lower meeting rails when the door is in a closed position.

DETAILED DESCRIPTION OF THE DRAWINGS

Figure 1:
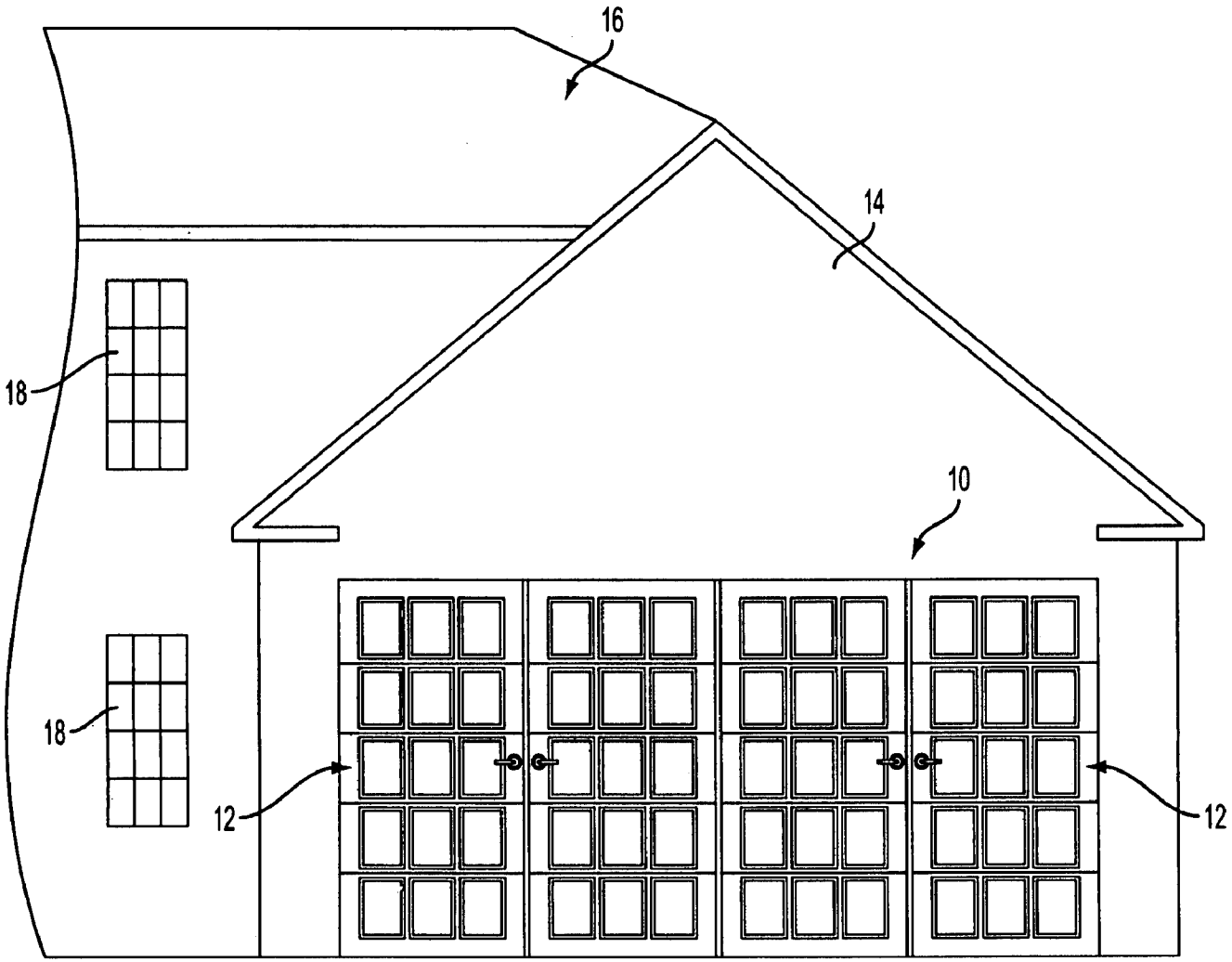
FIG. 1 shows a portion of a house with an attached garage having an embodiment of an overhead garage door in accordance with the present invention.

One embodiment of the present invention is the overhead garage door 10 depicted in FIG. 1 that includes decorative façade elements 12 that simulate a set of four light-transmitting doors known commonly as French doors. A set of French doors typically includes two doors each having an array of divided lights. In the garage door 10, the lights are light-transmitting panels that transmit visible light.

Figure 2:
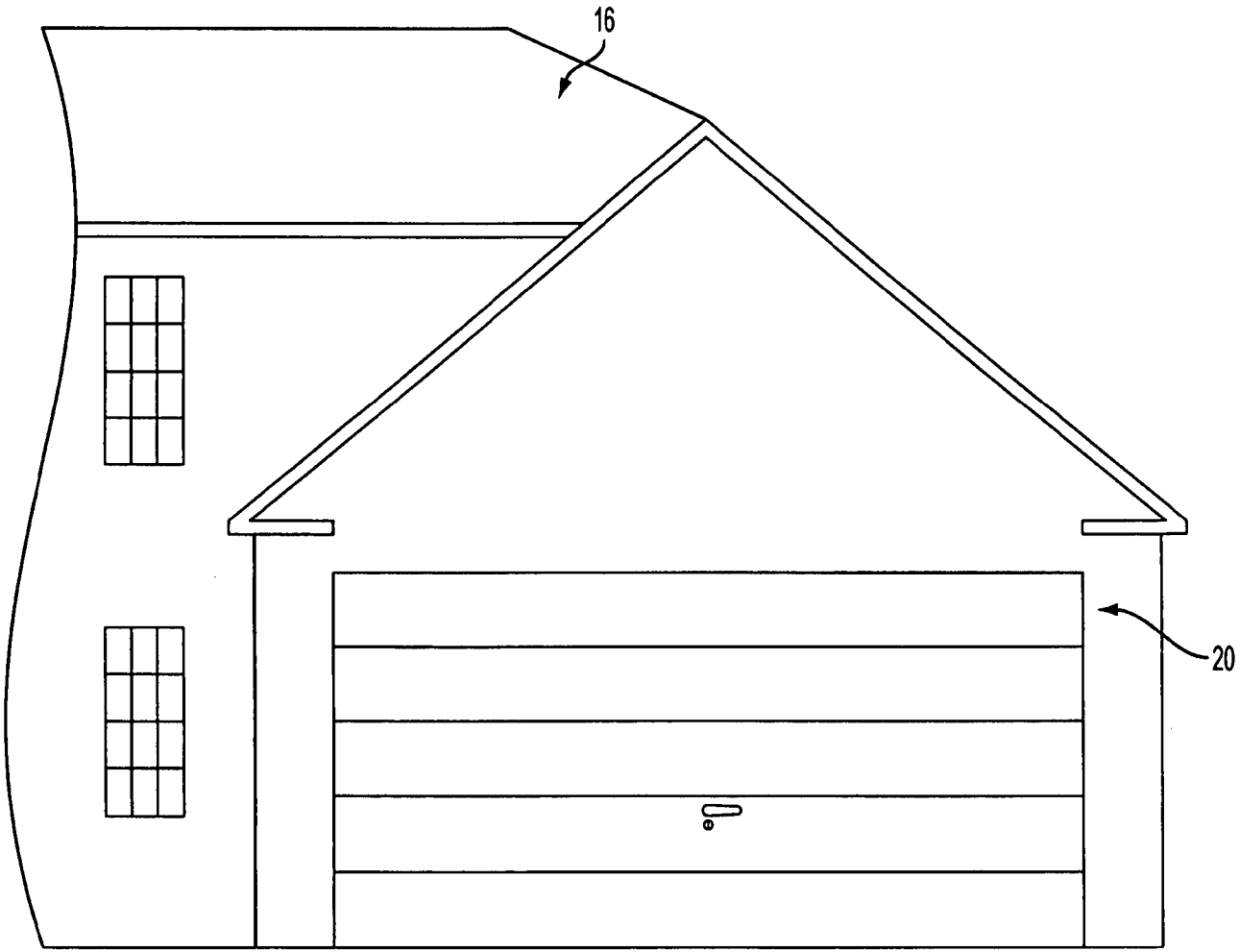
FIG. 2 PRIOR ART
FIG. 2 shows the house of FIG. 1, but with a conventional overhead garage door.

The garage door 10 is shown installed on a garage 14 of a conventional house 16. For illustration purposes, the house includes divided light windows 18. The facade elements 12 give the garage door 10 an attractive appearance that blends well with the style of the house 16, particularly with the divided light windows 18 of the house. In contrast, FIG. 2 shows a conventional garage door installed on the same conventional house 16. Rather than blending in with the style of the house 16, the conventional garage door 20 stands out as a monolithic blank space that detracts from the appearance of the house.

Figure 3:
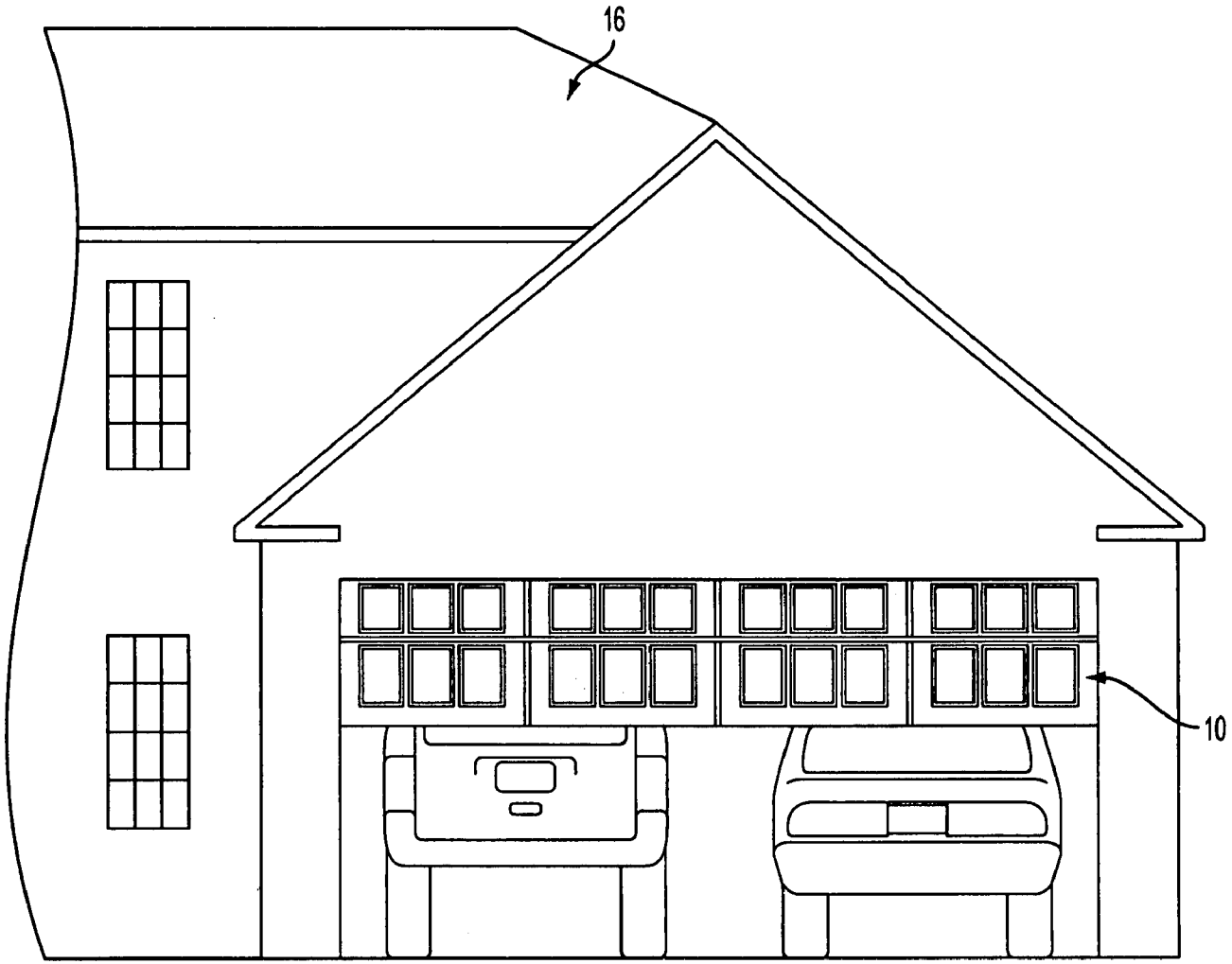
FIG. 3 shows the garage door of FIG. 1, but with the overhead garage door shown in a partially opened condition.

Referring now to FIGS. 4-7, the overhead garage door 10 includes a door 22, four arrays 24 of light-transmitting panels 26, guide rollers 28, and guide tracks 30. The door 22 includes sections 32 arranged in a stack, and hinges 34 pivotally connecting adjacent sections 32. Guide rollers 28 are connected to edge portions of the sections 32 and are retained in a guide track 30 attached to the garage. The track has a vertical section and a horizontal section and extends at a right angle from a vertical position to a horizontal position. The guide rollers 28 are each received in a channel 31 in one of the guide tracks 30. The garage door 12 opens and closes by rolling on the guide rollers along the guide tracks 30 from a vertical closed position to an overhead horizontal open position, and vice versa, as is known in the art. To illustrate, FIG. 3 shows garage door 10 in a position intermediate between the opened and closed position. Although embodied herein as a sectioned garage door, the present invention works as well with unitary, slab-type overhead garage doors as are known in the art, or with other types of overhead garage doors.

Figure 4:
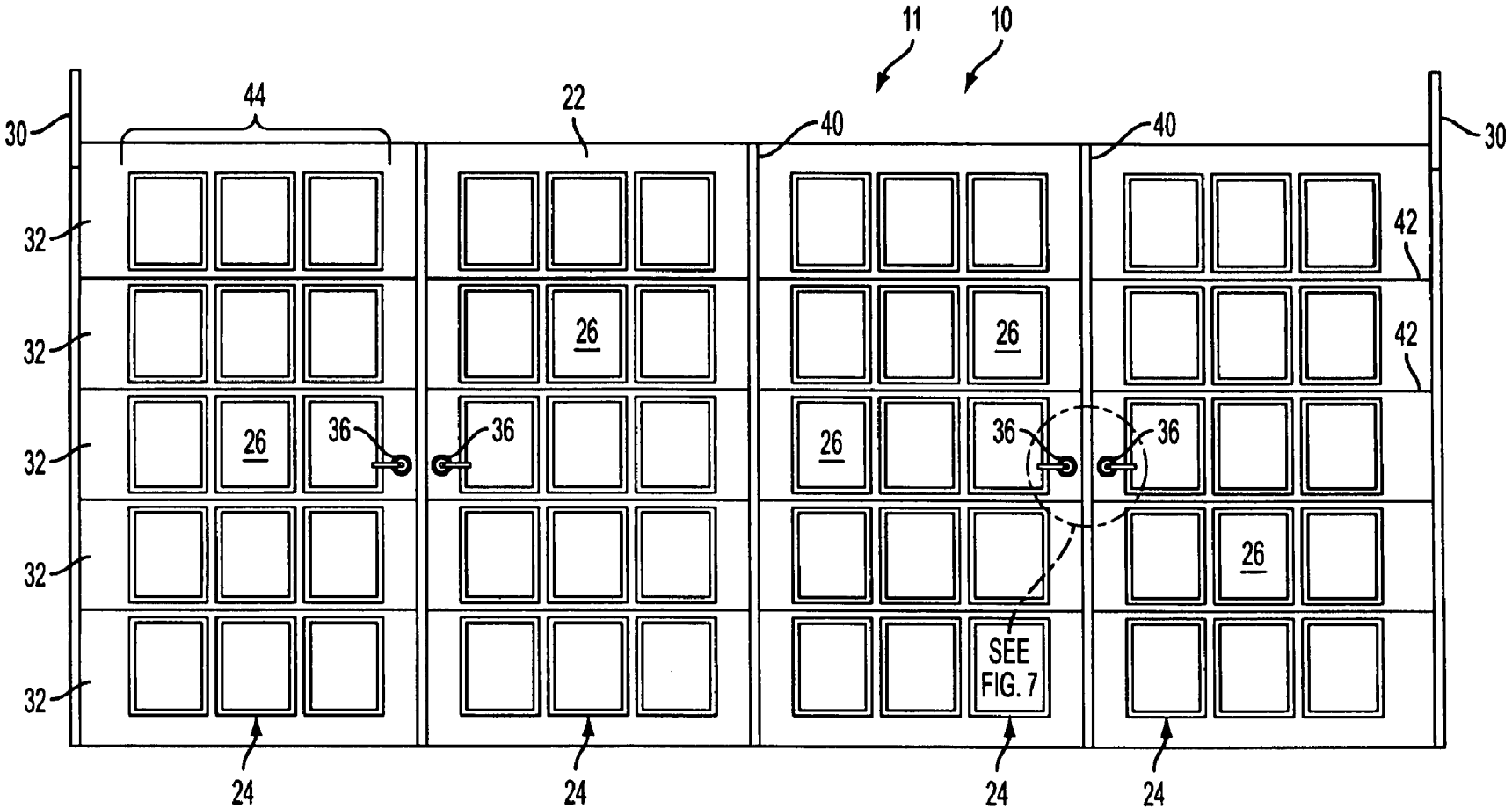
FIG. 4 is an exterior elevational view of the garage door of FIG. 1, including guide rails for connecting the door to the garage.
Figure 5:
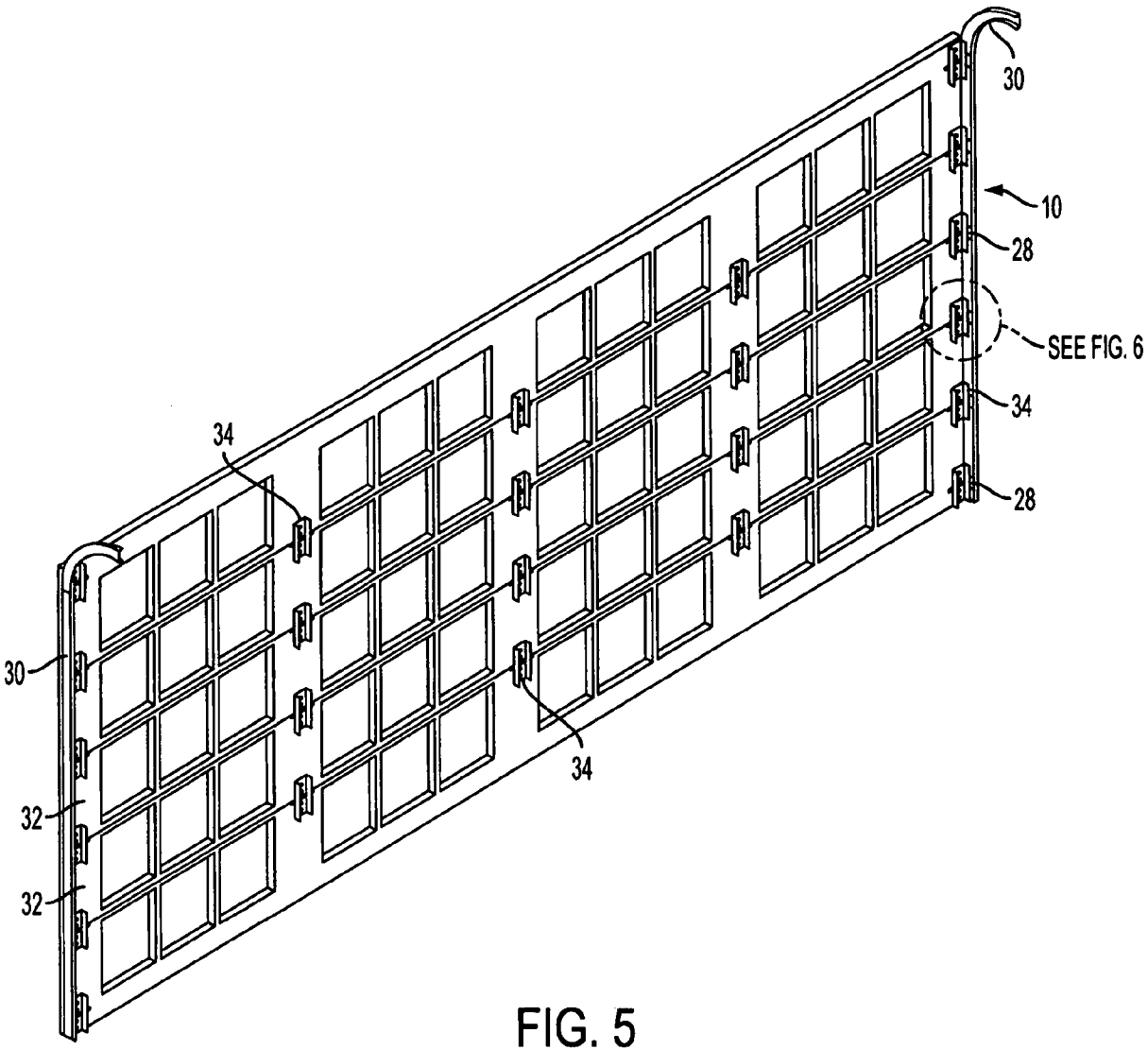
FIG. 5 shows an interior perspective view of the garage door of FIG. 4.
Figure 6:
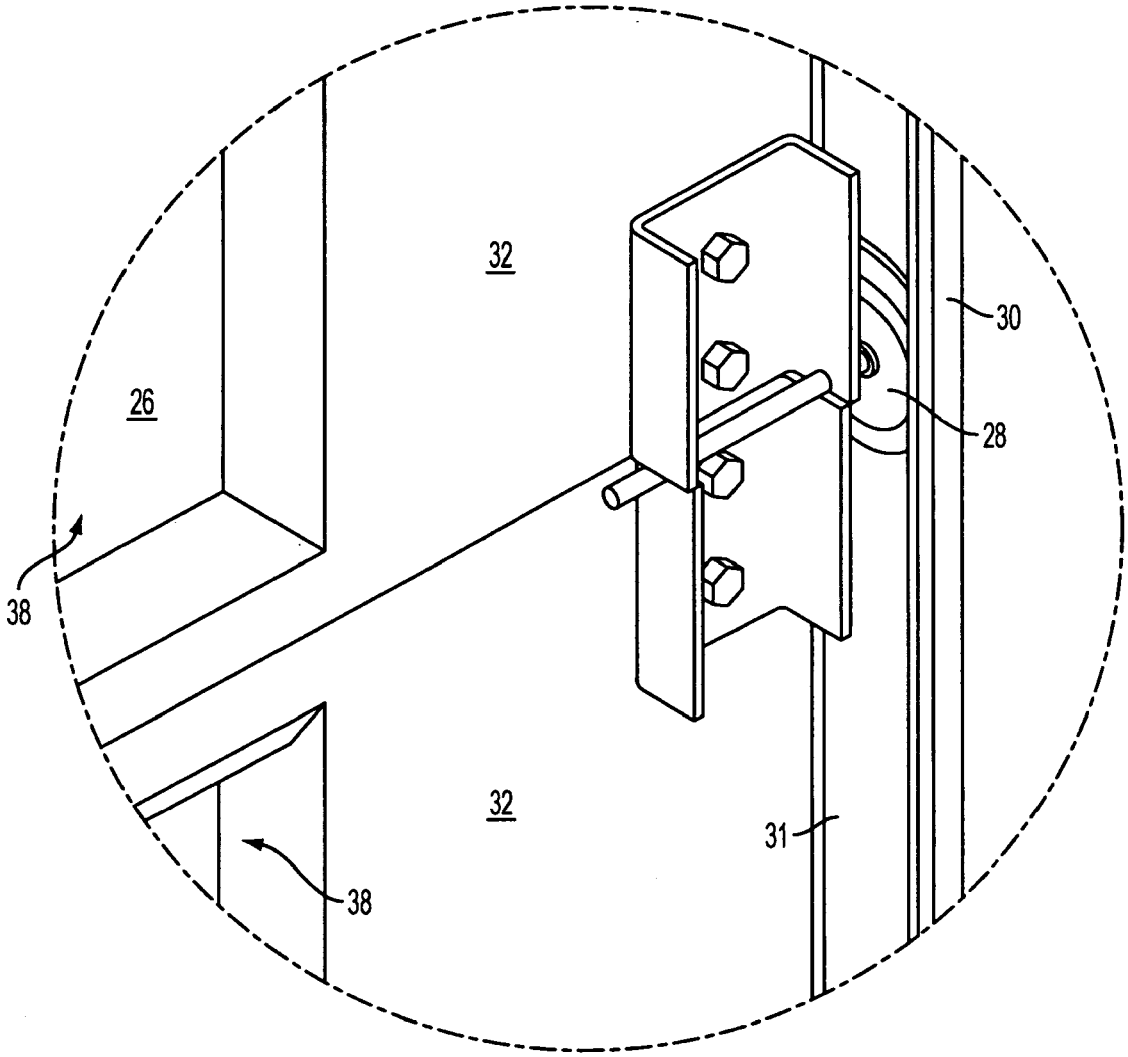
FIG. 6 shows a close-up perspective view of an interior portion of the garage door of FIG. 5, including a roller connected to a guide rail.
Figure 7:
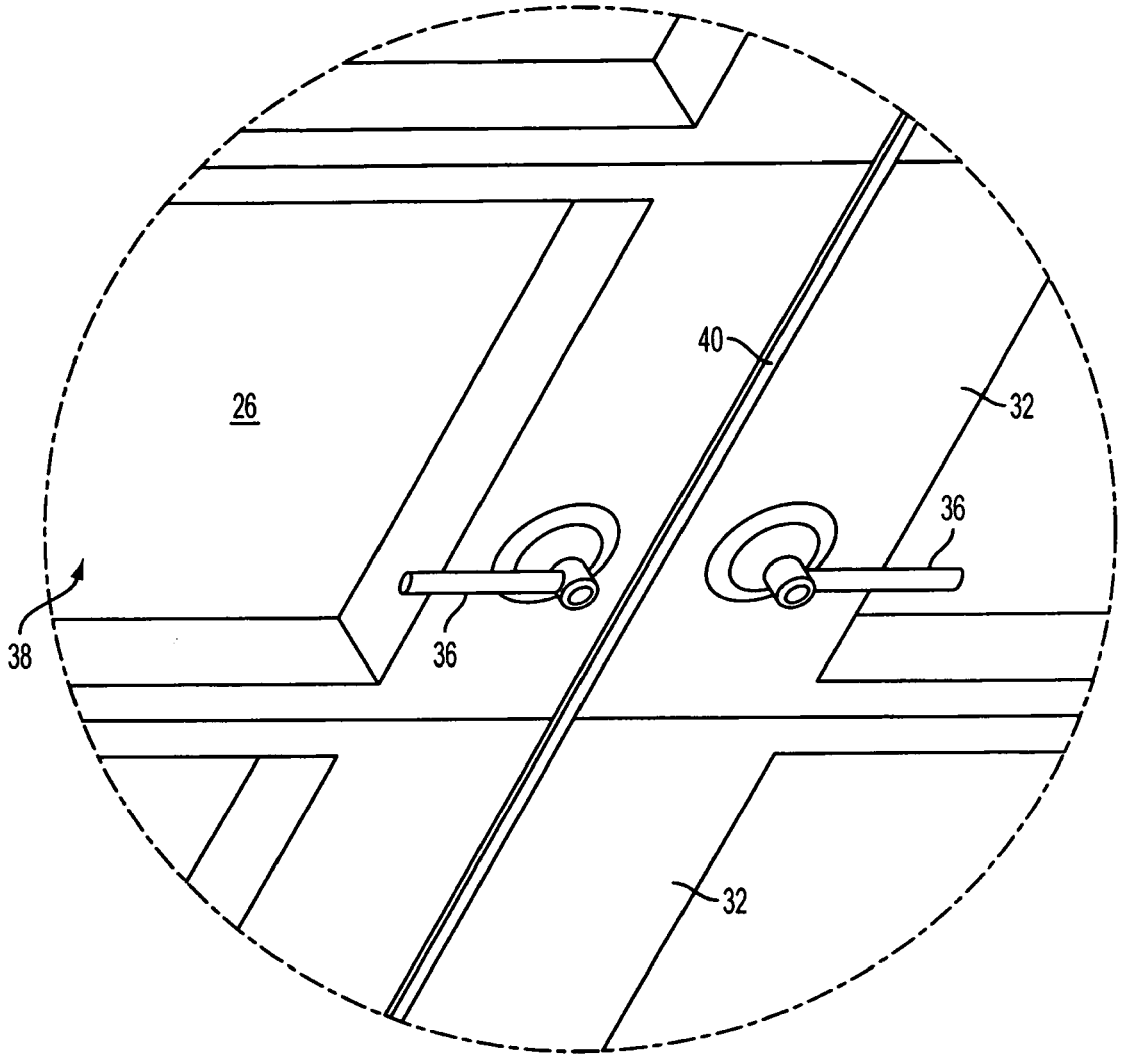
FIG. 7 shows a close-up perspective view of an exterior portion of the garage door of FIG. 4, including a vertical groove and door handles.

The arrays 24 of light-transmitting panels 26 shown in FIGS. 1 and 3-5 each include five rows by three columns, which generally match the appearance of regular French doors. The arrays 24 are spaced from one another along the door 22 to give the appearance of four separate passage doors. To enhance the appearance of separate doors, the overhead garage door 10 further includes door handles 36. Each array 24 in combination with a corresponding handle 36 generally forms a facade element 12 to simulate a light-transmitting door. Although the door handles 36 do not function to open the simulated doors 24, they may act as functional latches for opening the garage door 10 or as handles for lifting the garage door 10. To further simulate the appearance of French doors, each one of the light-transmitting panels 26 appear to be glazed in a section 32 as shown in FIGS. 6 and 7, which is similar to the manner in which glass is often glazed in window frames. Accordingly, beveled moldings 38 are provided in the sections 32 for retaining the light-transmitting panels 26. The panels 26 retained therein are able to transmit light from the outside environment into the interior of the garage 14.

The light-transmitting panels 26 preferably are translucent panels, which provide the benefit of transmitting light between the outside environment and the interior of the garage 14 without allowing persons outside of the garage 14 to clearly see into the garage. Thus, the present invention allows in a greater amount of natural light into the garage 14 compared with a conventional garage door. According to other embodiments, the light-transmitting panels 26 may include transparent panels, reflective panels, tinted panels, one-way mirrored panels, and the like to provide a desired level of privacy without sacrificing light. Further, the door arrays 24 may include a mix of different panel types, and may include opaque panels. Thus, the quantity of light transmitted into and out of the garage 14 can be custom tailored according to the light transmissibility of each one of the panels 26.

The panels 26 are preferably made of material which can be customized in appearance and strong enough to be a barrier in an environment that is prone to weather exposure, shop conditions, or other adverse environments. One example of such a material is polycarbonate acrylic sheets, which are lightweight and provide high impact resistance. These sheets can be made to have various light transmission properties, which can range from transparent to opaque. Polycarbonate acrylic sheets can also be made in a variety of colors and tints. The present invention further contemplates panels 26 made from a wide variety of plastics, glass, or other light-transmitting materials.

To enhance the effect of the façade elements 12 in simulating French doors, the door 22 also includes three vertical grooves 40. Each groove 40 is placed between a pair of panel arrays 24 to simulate the jambs of a set of adjacent doors. The grooves 40 additionally emphasize the appearance of simulated doors by drawing the eye away from the horizontal lines 42 created by the junction of adjacent sections 32. The grooves 40 are accentuated in comparison with the horizontal lines 42 by being much wider and deeper than the horizontal lines. Painting the grooves a dark color further increases their visual effect.

The garage door 10 of the present invention can be created from a kit 11 for making an overhead garage door that simulates a set of light-transmitting doors. Referring specifically to FIGS. 4 and 5, the kit 11 generally includes a number of sections 32 and a number of hinges 34 for connecting the sections 32. A row of light-transmitting panels 26 are mounted on each section 32, and the panels of each row are arranged in groups 44 of three panels spaced apart from adjacent groups. The garage door 10 is created by arranging the sections 32 into a stack to form the door 22, and connecting adjacent sections 32 to each other with hinges 34. The kit 11 also includes guide rollers 28 and guide tracks 30 for mounting the assembled door to a garage, and door handles 36 for mounting on one of sections 32.

Figure 14:
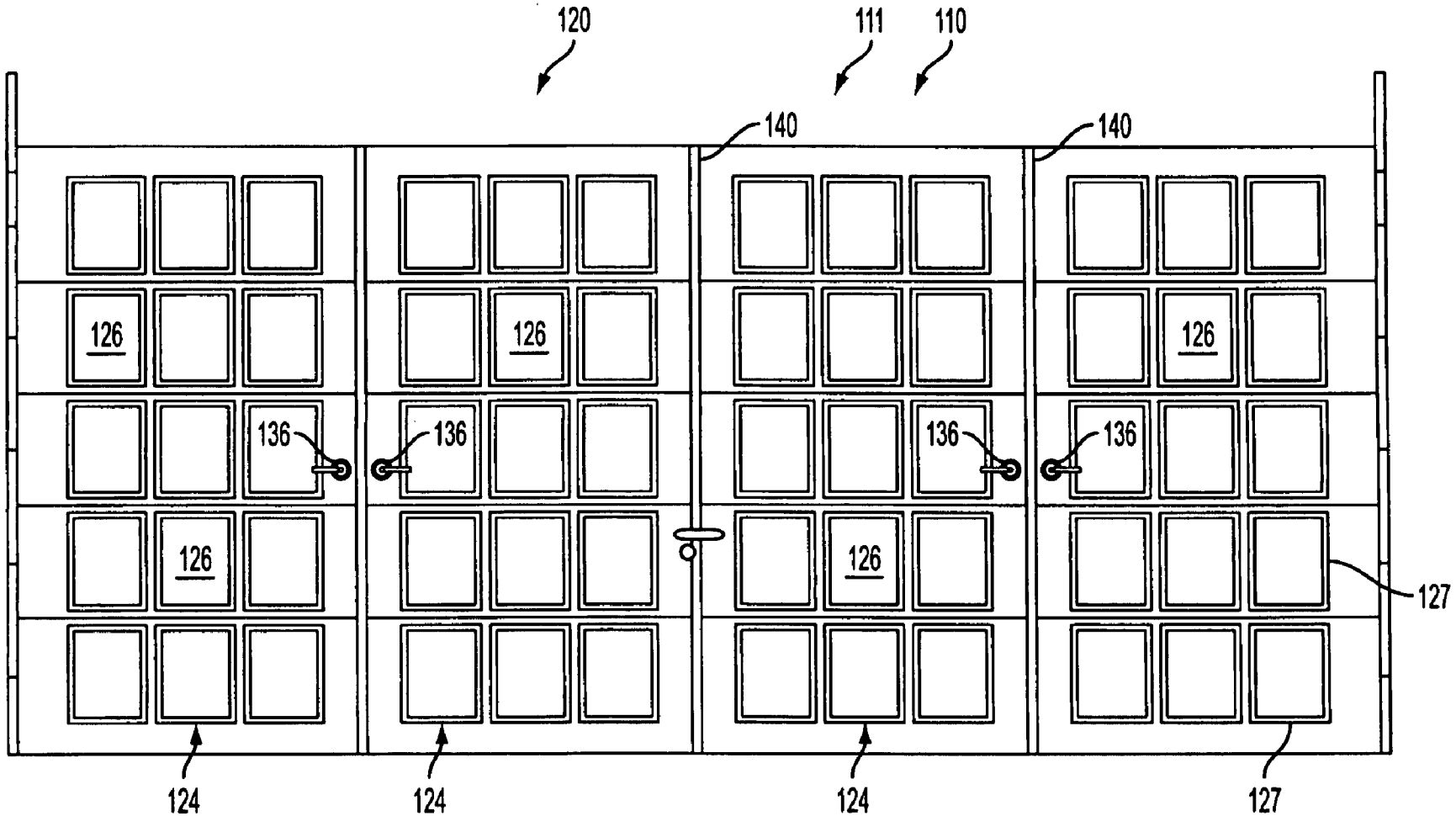
FIG. 14 shows an exterior elevational view of an additional embodiment of an overhead garage door in accordance with the present invention.

A garage door 110 according to another embodiment of the present invention can be created from a retrofit kit 111 for modifying the appearance of an existing overhead garage door to simulate a set of light-transmitting doors. Referring to FIG. 14, the retrofit kit 111 generally includes decorative panels 126 and door handles 136. The decorative panels 126 are mounted to a conventional garage door 120 (such as the conventional garage door 20 shown in FIG. 2) in a set of arrays 124 to give it the appearance of a set of French doors. In order to allow light to transmit through the panels 126, holes (not shown) may be cut into the garage door 120 prior to mounting the panels. The panels may be mounted over or within the holes (not shown) according to known methods. The panels may include beveled edges 127 to simulate the frame elements of a French door. The handles 136 are each mounted next to an array 124 to further simulate light-transmitting doors. An optional vertical stripe 140 may be painted onto the garage door 120 to simulate the jambs of adjacent simulated French doors.

Figure 8:
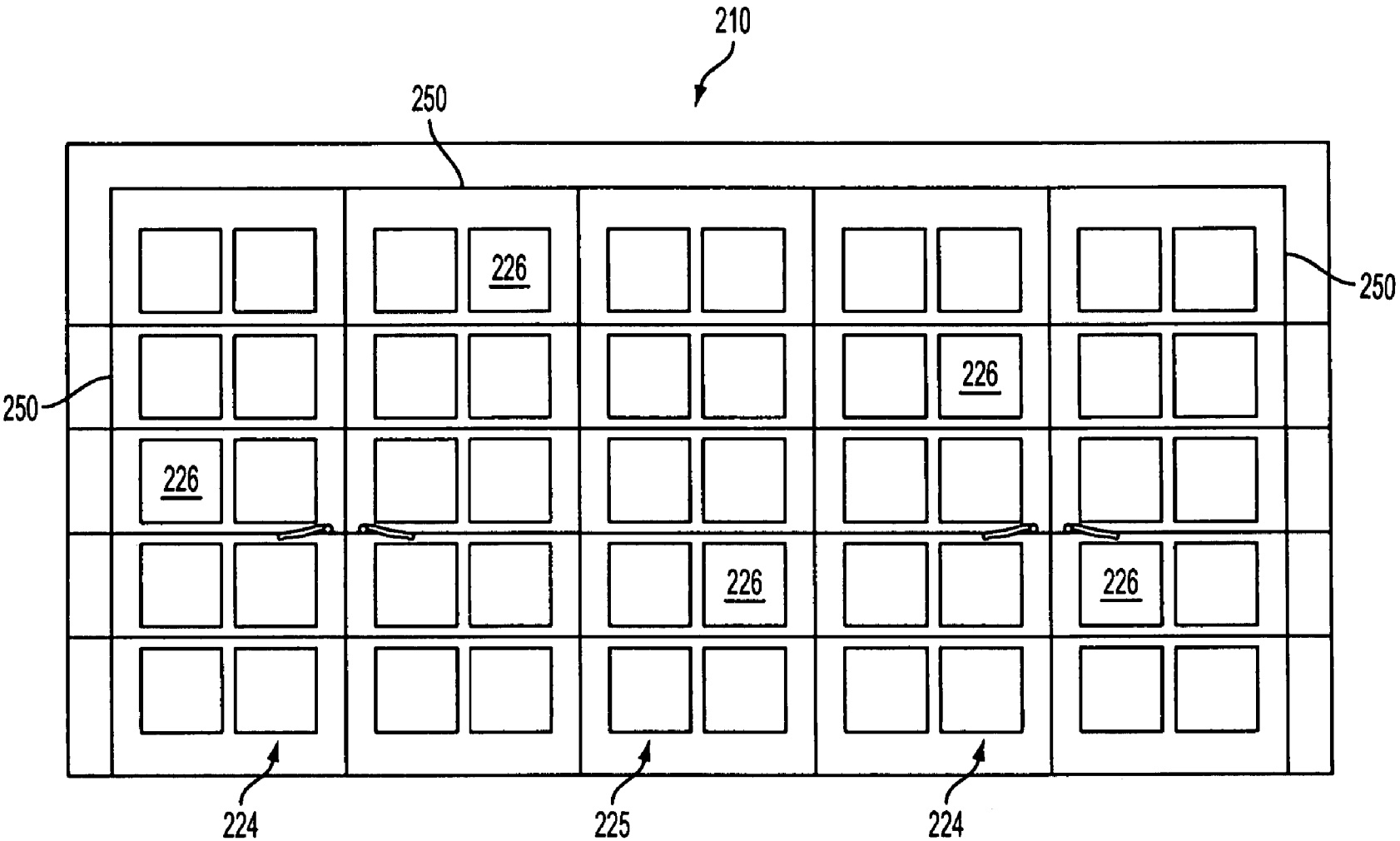
FIG. 8 shows an exterior elevational view of another embodiment of an overhead garage door in accordance with the present invention.

The present invention is flexible in that it allows for variety in the design of facades and in the types of light-transmitting doors simulated. For example, a further embodiment of an overhead garage door in accordance with the present invention is shown in FIG. 8. In this embodiment, there are five arrays 224 of light-transmitting panels 226 simulating a set of four light-transmitting doors centered about a window array 225. The arrays 224 are arranged into two by five arrays having two columns and five rows. The garage door 210 further includes borders 250 simulating the jambs and top edges of each simulated door and the window. The borders 250 are preferably formed by grooves in the garage door, but may also be formed from painted stripes, adhesive strips, and other methods for marking a border. Except for preferences and aspects related to number, arrangement and size of arrays 224, or to the simulated borders 250, all other preferences and aspects are generally the same as for the previous embodiments.

Figure 9:
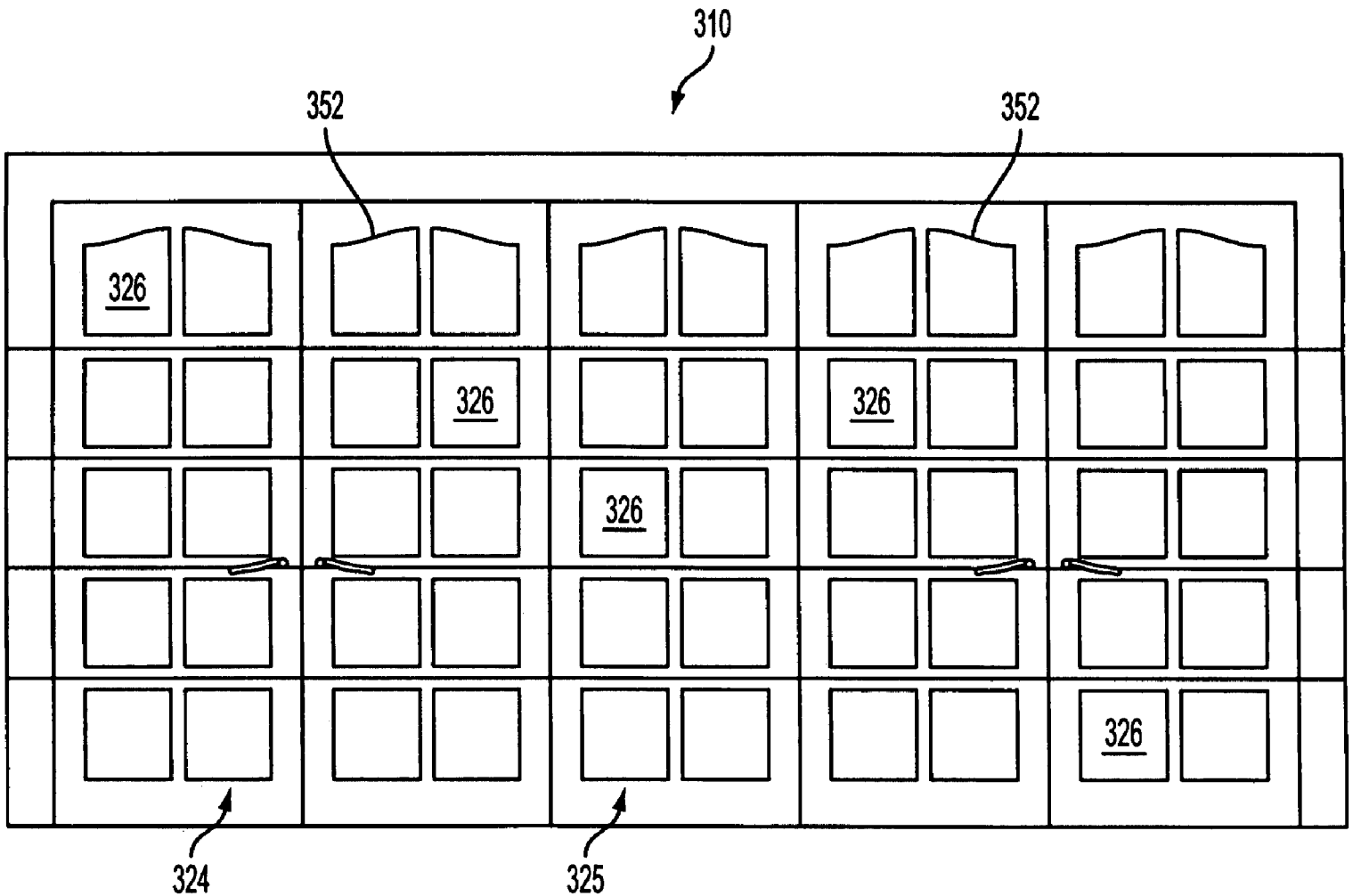
FIG. 9 shows an exterior elevational view of a further embodiment of an overhead garage door in accordance with the present invention.
Figure 10:
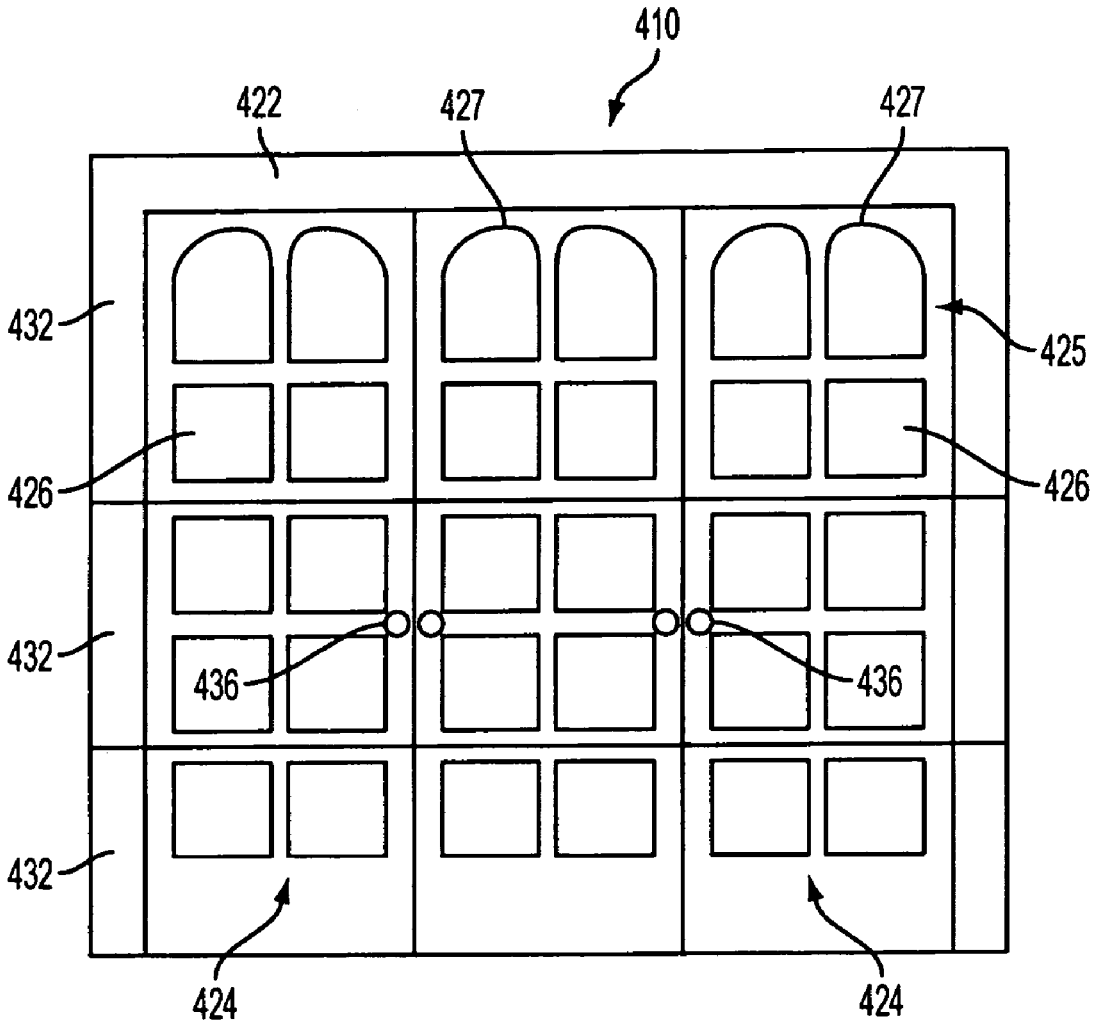
FIG. 10 shows an exterior elevational view of yet another embodiment of an overhead garage door in accordance with the present invention.
Figure 11:
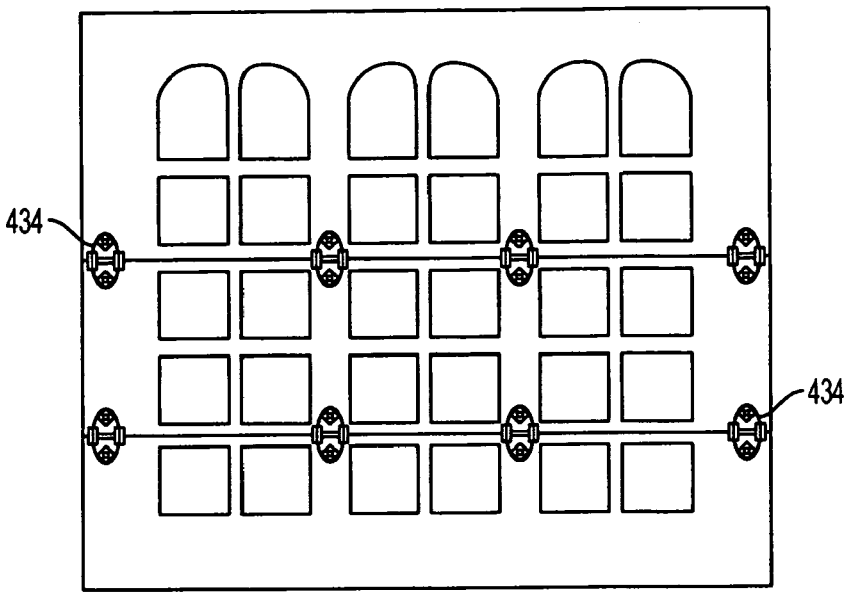
FIG. 11 shows an interior elevational view of the garage door of FIG. 10.
Figure 12:
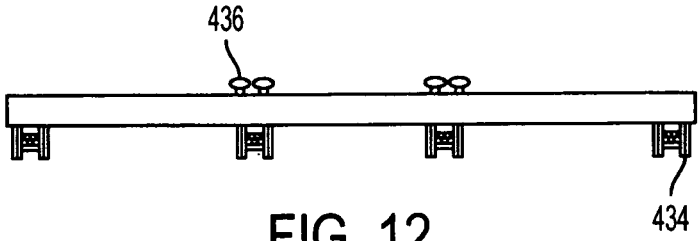
FIG. 12 shows a top view of the garage door of FIG. 10.
Figure 13:
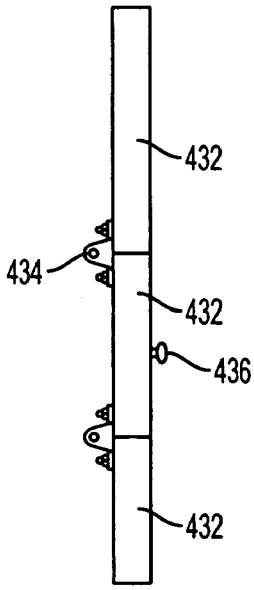
FIG. 13 shows a side view of the garage door of FIG. 10.

The present invention also provides flexibility in the size and type of panels used for the simulated light-transmitting doors. For example, an additional embodiment of an overhead garage door 310 in accordance with the present invention is shown in FIG. 9. This embodiment differs from the embodiment shown in FIG. 8 in that each panel in the top row of panels 326 include an ornate arching curvature 352 along its top edge. As illustrated in the top row 352, the panels 326 need not be rectangular or uniform in size and shape, and may include any number of decorative variations.

Referring now to FIGS. 10-13, yet another embodiment of an overhead garage door 410 in accordance with the present invention is shown. This embodiment demonstrates further flexibility in design according to the present invention, particularly for garage door design as well as for panel design and array layout. The garage door 410 according to this embodiment generally includes a door 422 and three arrays 424 of light-transmitting panels 426 simulating a set of three light-transmitting doors. The door 422 includes three sections 432 arranged in a vertical stack, and hinges 434 pivotally connecting adjacent ones of sections 432. The sections 432 in this embodiment are of different sizes, with the top section being wider than the middle section and bottom sections, and the middle section being wider than the bottom section. The arrays 424 are arranged into two by five arrays having two columns and five rows.

The garage door 410 represented by this embodiment demonstrates a number of design differences from other embodiments. For example, the panels 426 located in the top row 425 of each array are taller than the panels located in lower rows. In addition, each panel in the top row 425 has an arcuate top edge 427. Although the panels 426 are arranged into five rows, the panels are spaced over only three sections 432. Accordingly, the top two rows in each array are located on the top section, the middle two rows in each array are located on the middle section, and the lower row of each array is located on the lower section. As such, the simulated windows in each of the simulated doors appear to be upwardly offset from the bottom of the corresponding simulated door. The garage door 210 further includes borders 250 simulating the edges and tops of each simulated door, and round doorknobs 436 to enhance the appearance of doors.

Referring now to FIGS. 15-19 another embodiment of an overhead garage door 510 is shown that illustrates various aspects of the present invention pertaining to seams between the hingedly-connected sections, such as concealing the seams and improving the interconnection of adjacent sections at the seam region therebetween. As with the previous embodiments, garage door 510 includes decorative facade elements, such as light-transmitting panels 512, which simulate two sets of light-transmitting doors commonly known as French doors. However, aspects of the present invention pertaining to seams between the sections may be practiced with other door configurations, which may or may not simulate light-transmitting doors or even include light-transmitting elements.

Figure 15:
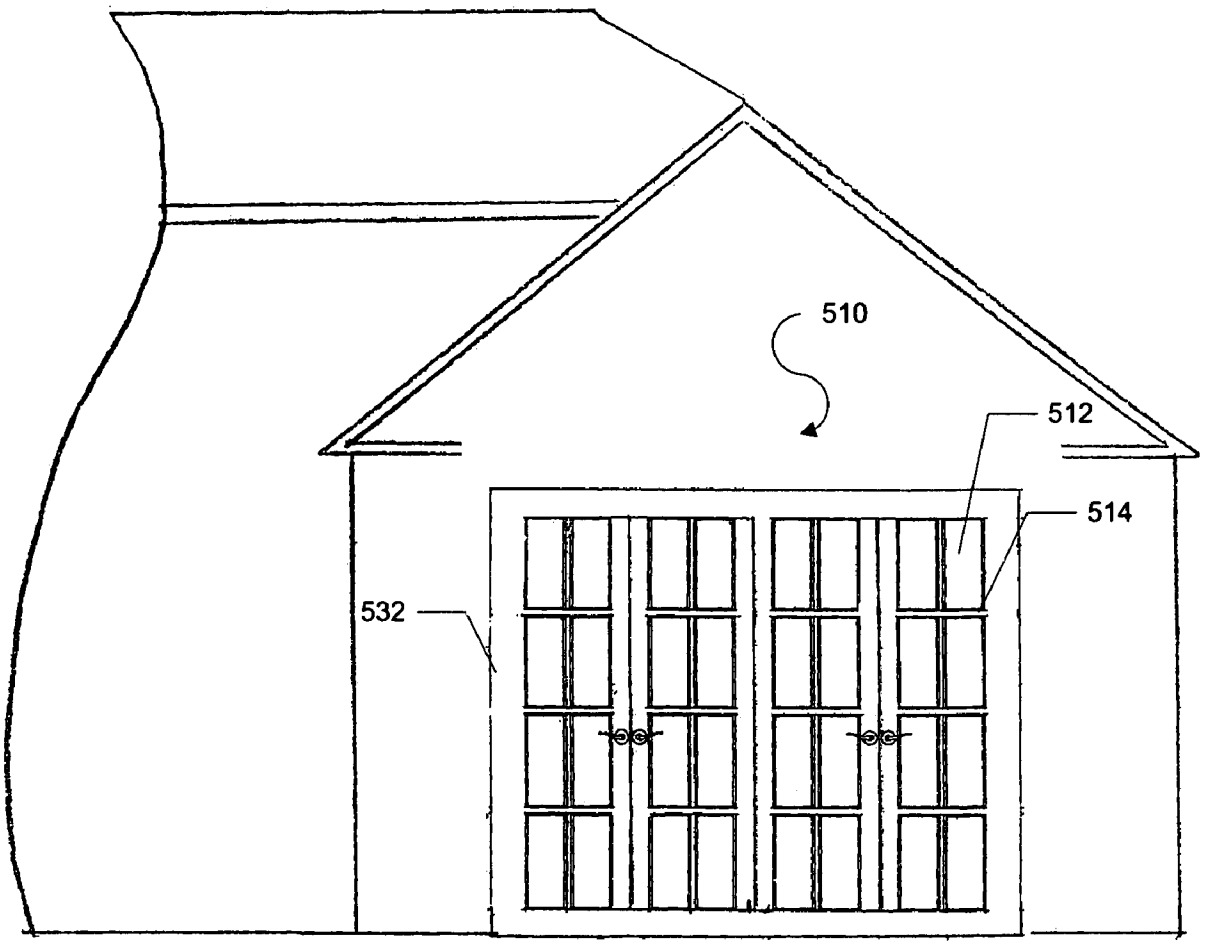
FIG. 15 shows an exterior elevational view of yet another embodiment of an overhead garage door in accordance with the present invention.
Figure 16:
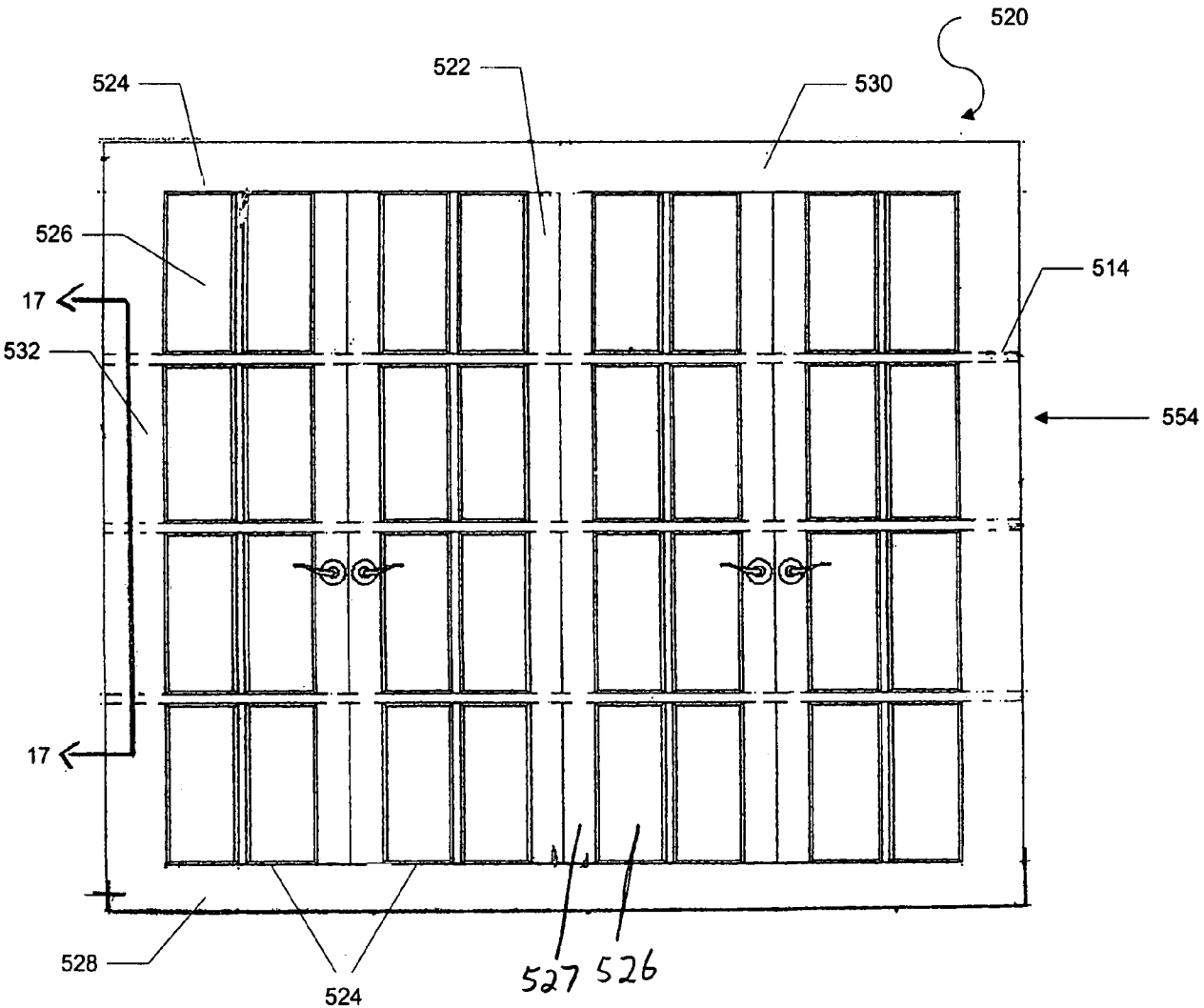
FIG. 16 is a front elevational view of the garage door of FIG. 15.

As shown in FIGS. 15 and 16, overhead garage door 510 includes a door 522, four arrays 524 of light-transmitting panels 526, end stiles 528 and 530 that form a top and bottom portion of door 522, guide rollers (not shown) and guide tracks (not shown). Door 522 includes horizontal sections 532 arranged in a vertical stack, and hinges 534 (FIG. 18) pivotally connecting adjacent horizontal sections 532. When installed on a building, guide rollers (not shown) attached to edge portions of the horizontal sections are retained in a guide track (not shown), which is attached to the garage. The track may have a vertical section and a horizontal section that generally form a right angle to guide the door from a vertical position to a horizontal position. The garage door opens and closes by rolling on the guide rollers along the guide tracks from a vertical closed position to an overhead horizontal open position, and vice versa, as is known in the art. Horizontal sections 532 are hingedly connected together to allow them to bend around the angled transition between the vertical section of guide track and the horizontal section of guide track.

Figure 18:
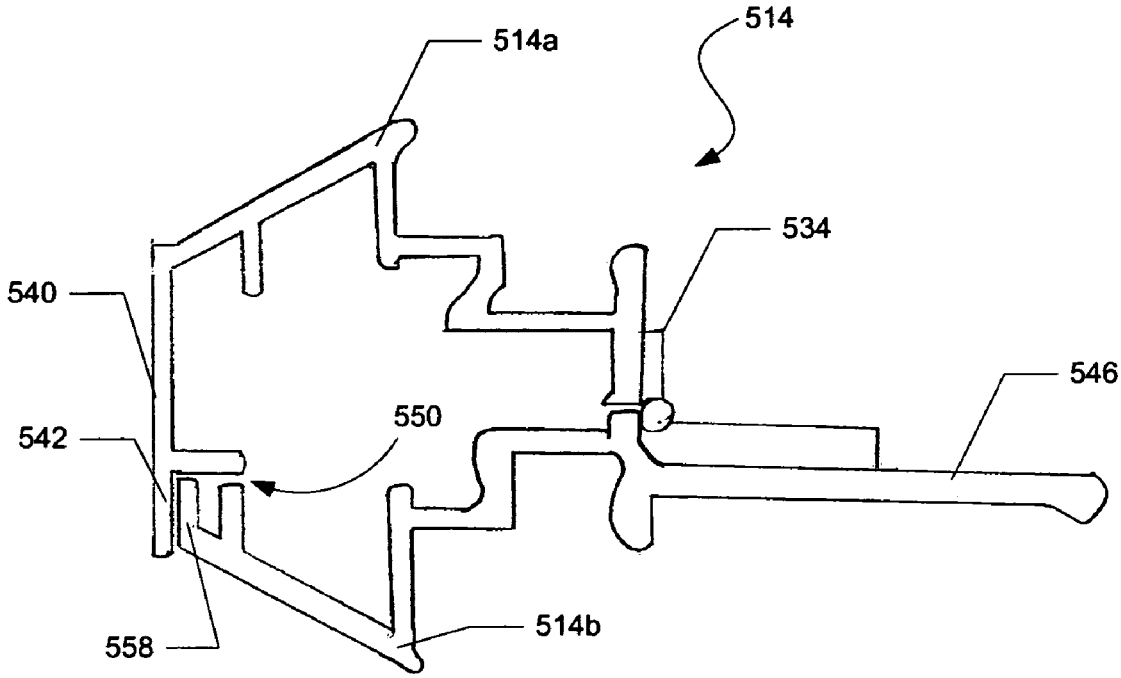
FIG. 18 is a cross sectional view of the set of meeting rails of FIG. 16.

Garage door 510 also includes a concealing apparatus, such as meeting rails 514, which are located at the joint between adjacent horizontal sections 532. As shown in FIG. 18, the meeting rails 514 are a pair of complementary pieces, an upper meeting rail 514*a* and a lower meeting rail 514*b*, that are joined by a hinge, such as surface mounted hinge 534. As the door 510 moves between a horizontal, open position and a vertical, closed position, adjacent sections 532 bend about hinge 534 to accommodate the angled transition between the two positions. Upper meeting rail 514*a* is attached to a bottom portion of an upper section 532 and rotates about hinge 534 with respect to lower meeting rail 514*b*, which is attached to an upper portion of an adjacent section. When the horizontal sections 532 are stacked in a closed position, a seam 550 (FIG. 18) is created where the two sections meet. Meeting rails 514 act as a concealing apparatus to mask seam 550 that is formed between adjacent sections.

Figure 17:
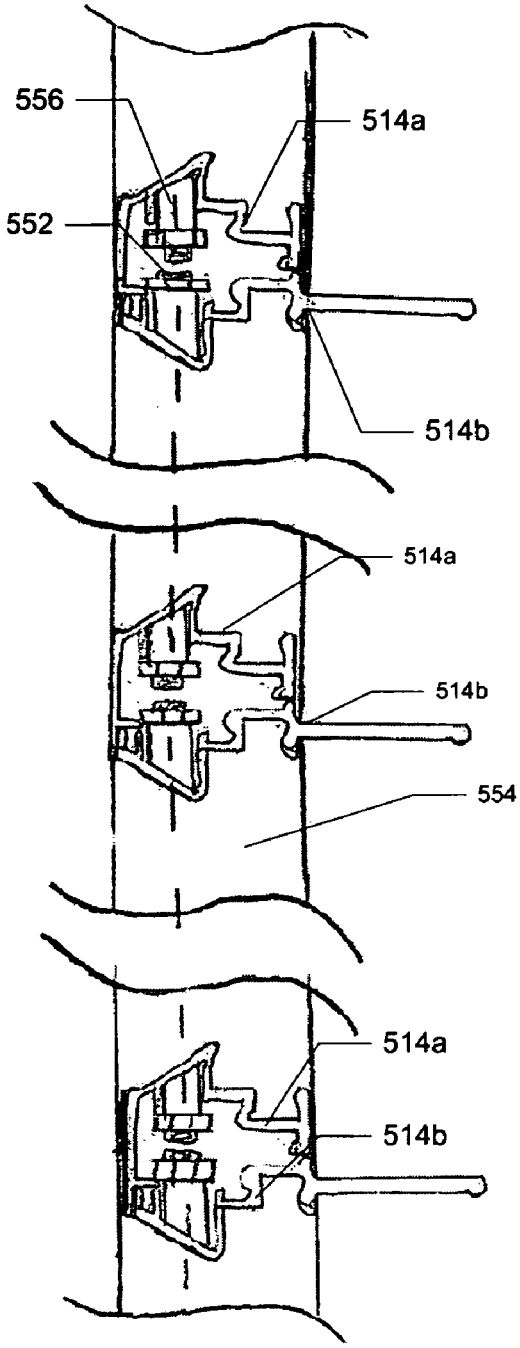
FIG. 17 is a cross sectional view of the garage door of FIG. 16 taken along line 17-17.

A pair of meeting rails for a particular section can be attached to each other via through bolts or other fasteners connecting them to the body of their respective section. As shown in FIG. 17, a first meeting rail (e.g., 514*a*) for a particular section can be connected to an opposite meeting rail (e.g., 514*b*) for the particular section via fasteners, such as a series of through bolts 552. As shown, bolt 552 extends vertically from the first one of the rails, through a body portion 554 of the section, and to the opposite one of the rails. If the section is one of the top or bottom sections for the door, the through bolt could attach to either the top stile 530 (FIG. 16) or the bottom stile 528 and extend through the section's body to a rail on the opposite side of the section. As further shown in FIG. 17, through bolts 550 may include a collar 556 that is bevel cut to mate with geometric features (e.g., angles) of the respective meeting rail 514*a* or 514*b*, which can strengthen the structural connection and aid with its assembly.

Through bolts 552 act in tension to draw the opposite rails or rail/stile pair toward each other and, thereby, to sandwich the body portion between the pair in compression. As shown in FIG. 16, the body portion 554 can include an arrangement of light-transmitting panels 526 and structural supports 527, such as solid panels. As discussed above for other embodiments, the panels may be formed from metal (e.g., aluminum), wood or other types of support materials.

Meeting rails 514*a* and 514*b* may be made from various substantially rigid materials, such as aluminum, steel and rigid plastic materials. In one embodiment, the rails are made from aluminum, such as 6063T-3 aluminum. Rails made from aluminum can be relatively lightweight while providing a robust hinge apparatus with durable mating surfaces, which can maintain its shape for many years through multiple openings and closings of the door. The rails may be manufactured through various processes, such as by extruding aluminum or plastic, welding steel pieces together, or thermoforming plastic materials. In addition, the meeting rails 514*a* and 514*b* can be manufactured to appear as a material similar to that of the rest of the door and of the same color to match the exterior appearance of the door 510.

As further shown in FIG. 18, upper rail 514*a* and lower rail 514*b* are preferably asymmetrical. As discussed further below, their asymmetrical shapes can provide advantages, such as masking seams between door sections, aiding the assembly and structural integrity of door sections, and enhancing door rigidity in the closed position. Upper rail 514*a* can include a flat front surface 540 that is visible on the front of garage door 510 when installed. The flat front surface 540 can reduce the appearance of seam lines created by adjoining horizontal sections 532. The flat front surface 540 is configured to cover the seam between the section to which it is attached and the adjacent section and, thereby, to provide a more aesthetically pleasing door than one having visible seams. As shown, lower rail 514*b* may have an extended flange 546 that provides a surface to which hinge 534 can be mounted. As the door is raised or lowered, the meeting rails 514*a* and 514*b* rotate apart about hinge 534 to allow the door to move to the open or closed position.

In addition to providing aesthetic benefits gained by concealing seams between sections, the flat front surface 540 of upper rail 514*a* can also aid the insulation properties of the door. The flat front surface 540 includes an overlap 542 that overlaps a corresponding under surface 558 of the lower rail and, thereby, provides a tight seal at seam 550. The overlap seal configuration can provide protection against air and moisture seeping between the horizontal panels of the door and, thus, provide a weather-tight seal. The overlap seal configuration further prevents any moisture that may possibly seep behind the flat front surface 540 from penetrating further. Any such moisture would meet with under surface 558 of the lower rail and will not be able to penetrate to the inside of the door. The overlap seal configuration also encourages precipitation and other fluids contacting the exterior of the door to move downward past the seam without being able to enter it. In general, the overlap seal configuration acts as a barrier against wind, moisture and debris, to reduce undesired infiltration into the garage.

Additional advantages can be realized when a concealing apparatus, such as meeting rails 514, is used with a sectional door having aesthetic features, such as facade elements or other elements that simulate the appearance of something other than a sectional door. For instance, the use of meeting rails 514 with an overhead garage door that incorporates French door facade elements can enhance the facade elements by concealing the seams 550 between adjacent sections. The seams created by the adjoining horizontal pieces can detract from the appearance of the door and the desired look created by the French door design. Concealing the horizontal seams in such an overhead garage door provides a uniform door appearance that is consistent with actual French doors and other types of vertically hinged doors.

Figure 19:
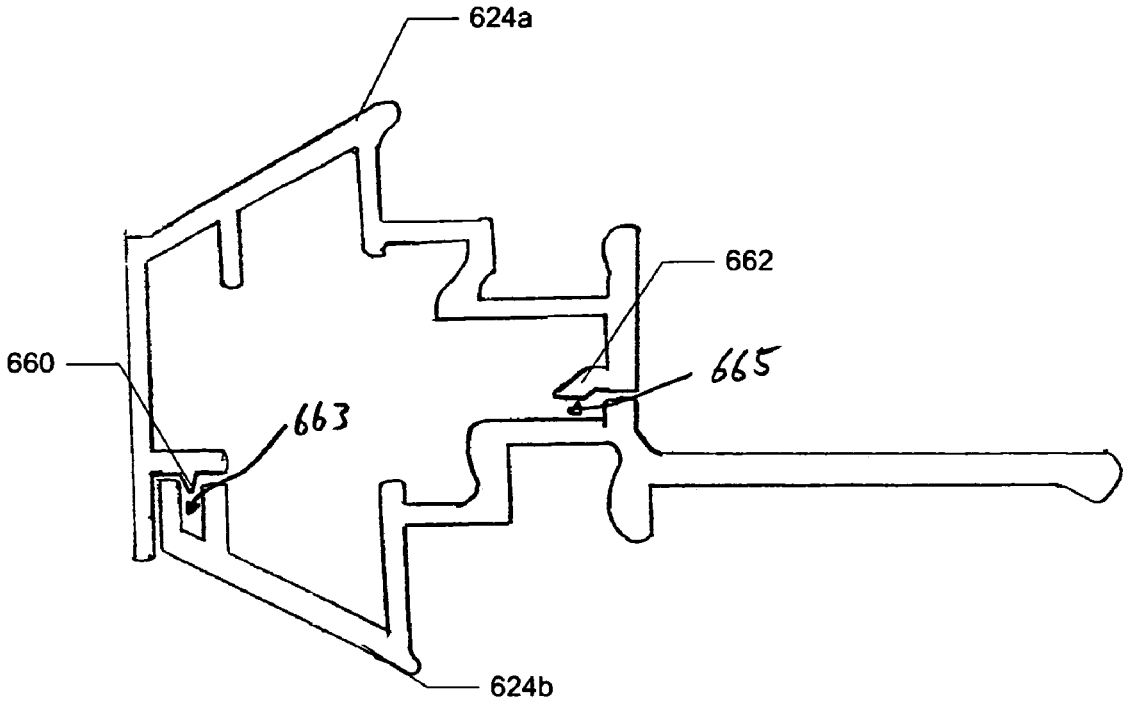
FIG. 19 is a cross sectional view of a set of meeting rails according to another embodiment of the invention.

FIG. 19 depicts an alternate embodiment of the meeting rails 624*a* and 624*b* for use with a sectional door, such as garage door 510. Upper meeting rail 624*a* includes an additional lip 660 protruding downward. This lip 660 may be located on a horizontal portion of the rail adjacent to the flat front surface 640 of upper guide 624*a*. An additional lip 662 may be located on the upper guide 624*a* and may protrude from the vertical back portion of the upper guide 624*a*. This lip protrudes toward the flat front surface 640 and downward toward the lower meeting rail 624*b*. The additional lips 660 and 662 may be formed in each of the meeting rails 624*a* and 624*b* during manufacture. For instance, the meeting rails 624*a* and 624*b* can be formed by an extrusion process to include additional lips 660 and 662.

Additional lips 660 and 662 can aid in installation of the meeting rails 624*a* and 624*b*. The lips 660 and 662 can assist with aligning the meeting rails 624*a* and 624*b* to thereby simplify installation of adjacent sections to each other. In addition, the lips 660 and 662 can aid with locking the meeting rails 624*a* and 624*b* together while the door is in a closed position. The lips 660 and 662 permit the upper meeting rail 624*a* to interconnect with corresponding recesses 663 and 665 of the lower meeting rail 624*b* to enhance the security and structural integrity of the door when in the closed position.

Figure 20:
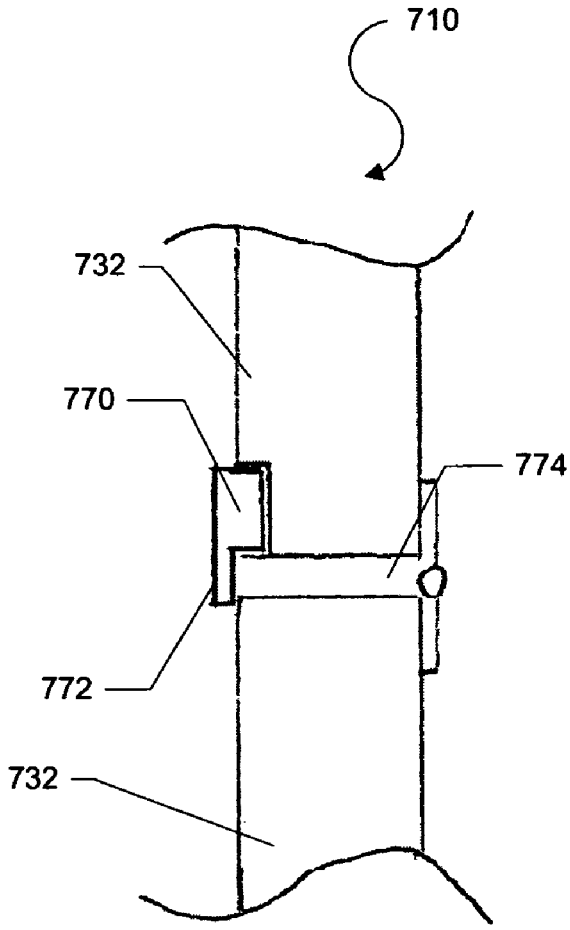
FIG. 20 is a cross sectional view of a portion of an overhead garage door according to a further embodiment of the invention.

FIG. 20 shows a concealing apparatus 710 according to another embodiment of the invention. As shown, concealing apparatus 710 generally includes an overlap plate 770 attached to a lower portion of a door section 732, such that it overlaps and conceals a gap 774 formed between adjacent sections. Plate 770 may be attached to garage door section 732 by way of a fastener, e.g., screw, bolt, and the like. The overlap plate 770 may also have an overlapping portion 772 that can conceal a seam 774 created between two adjoining horizontal sections 732 of the garage door 710. The overlap plate 770 can act as a barrier against wind, moisture and debris and will also mask the seam 774 to improve the appearance of the door 710.

Although the subject matter has been described in language specific to structural features, it is to be understood that the subject matter defined in the appended claims is not necessarily limited to the specific features described above. Rather, the specific features described above are disclosed as example forms for implementing the claims. Further, it is appreciated that aspects of the invention discussed herein may be practiced alone or in combination with other aspects, and they may be practiced in a variety of door configurations.

We claim:

1. An overhead garage door having a front side, a rear side and a height when in a closed, vertical position, the front side forming an exterior façade having the appearance of a plurality of adjacent light-transmitting doorways, the overhead garage door comprising:

a plurality of longitudinal sections arranged in a vertical stack when the garage door is in the closed position;

a first section of the plurality of longitudinal sections;

a second section of the plurality of longitudinal sections, a top portion of the second section being adjacent to a bottom portion of the first section in the closed position and forming a horizontal gap therebetween;

a pair of meeting rails attached to the first and second sections and forming the gap, the pair of meeting rails having a first lip and a second lip aligning the pair of meeting rails with each other while in the closed position, the first lip forming a first protrusion formed on a first one of the meeting rails interconnecting with a first recess formed on a second one of the meeting rails and the second lip protruding forward toward the front side of the overhead garage door, from a rear of the meeting rails and into a second recess toward a front of the meeting rails, the meeting rails including a concealer covering the horizontal gap when in the closed position;

a hinge connection between the first and second sections;

a first array of first panels arranged on the plurality of longitudinal sections, the first array extending vertically more than half the height of the door when in the closed position, the first array including a first vertical stack of the first panels and a second vertical stack of the first panels, the first vertical stack being horizontally spaced apart from the second vertical stack by a first vertical gap;

a second array of second panels arranged on the plurality of longitudinal sections, the second array extending vertically more than half the height of the door when in the closed position, the second array including a third vertical stack of the second panels and a fourth vertical stack of the second panels, the third vertical stack being horizontally spaced apart from the fourth vertical stack by a second vertical gap;

a first vertical groove formed by portions of the plurality of longitudinal sections disposed within a first horizontal space between the first array and the second array, the first vertical groove being wider and deeper than the horizontal gap formed between the first section and the second section; and a plurality of guide rollers;

wherein said arrays are arranged on said exterior façade to simulate adjacent, light-transmitting doorways.

2. The overhead garage door of claim 1, wherein the concealer includes an overlapping tab.

3. The overhead garage door of claim 2, wherein the pair of meeting rails have an overlap portion, the overlap portion forming the overlapping tab.

4. The overhead garage door of claim 1, wherein the pair of meeting rails further comprise an upper meeting rail and a lower meeting rail.

5. The overhead garage door of claim 4, wherein the upper meeting rail and lower meeting rail are asymmetrical.

6. The overhead garage door of claim 4, wherein the upper meeting rail further comprises a flat front surface.

7. The overhead garage door of claim 6, wherein the flat front surface of the upper meeting rail includes a vertical portion that overhangs the lower meeting rail.

8. The overhead garage door of claim 4, wherein the upper meeting rail includes a downward angled portion.

9. The overhead garage door of claim 4, wherein the upper meeting rail and lower meeting rail are made of aluminum.

10. The overhead garage door of claim 4, wherein the upper meeting rail and the lower meeting rail are made from an extrusion process.

11. The overhead garage door of claim 4, wherein the lower meeting rail includes a flange portion on which the hinge is mounted.

12. The overhead garage door of claim 4, wherein the first protrusion of the one or more lips is formed on the upper meeting rail and the recess is formed on the lower meeting rail.

13. The overhead garage door of claim 4, wherein the upper meeting rail and lower meeting rail are connected to a corresponding one of the first and second longitudinal sections by through bolts.

14. The overhead garage door of claim 2, wherein the overlapping tab is a plate having an attachment region and an overhanging region, the overhanging region covering the horizontal gap.

15. The overhead garage door of claim 1, further comprising:

a first lever door handle configured for lifting the door mounted proximate the first array; and a second lever door handle configured for lifting the door mounted proximate the second array.

16. The overhead garage door of claim 15, wherein at least one of the first and second lever door handles is configured to act as a functional latch for opening the door.

17. The overhead garage door of claim 15, further comprising a third lever door handle mounted proximate a third array of panels.

18. The overhead garage door of claim 1, wherein the first and second panels include decorative panels, each of the decorative panels being mounted to one of the longitudinal sections on the front side of the overhead garage door.

19. The overhead garage door of claim 18, wherein the first and second panels include light-transmitting panels.

20. The overhead garage door of claim 19, wherein the longitudinal sections include holes formed therein and the first and second panels are each mounted on one of the longitudinal sections over or within one of the holes.

21. The overhead garage door of claim 1, wherein the one or more lips further include a second protrusion interconnecting with a second recess while in the closed position, the first protrusion and the corresponding first recess cooperating with the second protrusion and the corresponding second recess to align the pair of meeting rails in the closed position.

22. The overhead garage door of claim 21, wherein the first protrusion and the first recess are disposed proximate the front face.

23. The overhead garage door of claim 22, wherein the second protrusion and the second recess are disposed proximate the rear side.

24. The overhead garage door of claim 1, wherein the first recess is formed via a pair of projections on the second one of the meeting rails spaced apart to form the first recess.

* * * * *